United States Patent [19]

Le Monnier de Gouville et al.

[11] Patent Number: 4,757,801

[45] Date of Patent: Jul. 19, 1988

[54] FLAT TYPE GAS BURNER

[75] Inventors: Jean-Bernard Le Monnier de Gouville; Bernard Dané, both of Veigne, France

[73] Assignee: Sourdillon-Airindex, Veigne, France

[21] Appl. No.: 48,298

[22] Filed: May 11, 1987

[30] Foreign Application Priority Data

May 12, 1986 [FR] France ..... 86 06756

[51] Int. Cl.[4] ..... F24C 3/00

[52] U.S. Cl. ..... 126/39 H; 126/39 K; 239/559

[58] Field of Search ..... 126/39 R, 39 H, 39 K; 239/559, 567

[56] References Cited

FOREIGN PATENT DOCUMENTS

| | | | |
|---|---|---|---|
| 2548951 | 5/1977 | Fed. Rep. of Germany | 126/39 H |
| 268035 | 10/1929 | Italy | 239/567 |
| 496544 | 10/1952 | Italy | 239/567 |

*Primary Examiner*—Carroll B. Dority, Jr.

*Attorney, Agent, or Firm*—Larson and Taylor

[57] ABSTRACT

Flat type gas burner with a body having a central vertical passage and a cap which define between them an annular convergent-divergent duct supplying flame orifices in the annular foot of the cap. The burner comprises an enclosure into which opens a flame orifice conferring on the mixture a flow speed identical with that of the other orifices. The volume of the enclosure permits an expansion of the mixture substantially to static pressure. The outlet aperture of the enclosure confers on the mixture a speed of flow 7 to 12 times less than that of the other orifices.

10 Claims, 1 Drawing Sheet

FLAT TYPE GAS BURNER

BACKGROUND OF THE INVENTION

The present invention relates to improvements in or to flat type gas burners, particularly for a domestic appliance. The gas burner comprises a burner body provided with a cylindrical vertical, axial gas inlet passage which shields a gas injector, and a cap covering the burner body and resting on the latter through an annular crown provided with flame orifices distributed circumferentially. The annular surface of the burner body bordering the outlet of the inlet passage for the gaseous mixture and the opposite surface of the cap are frustoconic to define an annular convergent-divergent system extending approximately across the gas jet. The burner body and the crown define, in addition, between their opposite surfaces, an annular decompression chamber situated between the abovesaid convergent-divergent system and the flame orifices.

The present trend in the field of furnishing kitchens is, more and more, towards completely built-in electrical home appliances. That is, the appliances are supported against a wall and enclosed between two neighboring pieces of furniture and/or equipment of substantially the same height.

This trend also affects gas cookers, with the result that there no longer exists any possible air flow around the appliance or within the latter, around the oven and to the outside. The only opening directed outwardly remains the chimney for removing combustion products from the oven and, as the case may be, from the grill.

When, in equipment thus installed, the oven door is manipulated a little too rapidly, there occurs in the oven an over-pressure on the closing of the door or an under-pressure on opening the door. The only route for the passage of air for reequilibrating the air pressure in the oven remains the chimney of the oven. However, the cross-section of the latter is determined exactly to stabilize a correct temperature in the oven and in general it is insufficient to deliver by itself the air flow necessary for reequilibrating the internal pressure. Consequently, the air movement takes place, at least partly, through the orifices for supplying the oven with fresh air. These orifices open into the inner space of the oven between the sides and top walls of the appliance. Now, it is also in this inner space that there are situated the apertures for taking in primary air for the burners. These apertures are supported immediately above the burners, on the upper wall forming the stove top. As a result, the pressure variation due to the actuation of the door of the oven is transmitted right into the burners. Whatever the type of burner equipping the stove, this pressure variation of the air in the very heart of the burner is prejudicial to the stability of the flames. There is even a risk of it becoming dangerous, by reason of the liability to extinction of the burners when operating at idling rate.

In particular, in the case of flat type burners, the configuration of these burners results in there not being a sufficient expansion volume, between the convergent-divergent system and the flame orifices, to damp a sudden pressure variation of the air. In this case, there exists a real risk of extinction of the flames, either by blowing out the flames (over-pressure of the air generated on the closing of the oven door), or by aspiration of the flames (under-pressure of the air caused on the opening of the door of the oven).

GENERAL DESCRIPTION OF THE INVENTION

Accordingly, it is an essential object of the invention to overcome this drawback and to provide an improved arrangement for a flat type burner which help prevent extinction of the flames on a variation of pressure of the primary air, caused particularly by the actuation of the oven door in the case of completely built-in ovens.

For this purpose, a burner of the flat type arranged according to the invention is characterized essentially by the combination of the following features:

on the periphery of the burner, there is provided at least one enclosure open outwardly and into which opens at least one of the abovesaid flame orifices, the cross-section of their supply orifice is such that it ensures a flow speed of the gaseous mixture in the vicinity of the flow speed through the flame orifices, the volume of the enclosure is such that is enables an expansion of the gaseous mixture so that the pressure inside the enclosure is close to the static pressure, and the cross-section of the outlet aperture of the enclosure is such that the flow speed of the gaseous mixture is about 7 to 12 times less than the speed of the gas flow supplying the flame orifices.

Thus, at least one flame orifice is associated with an expansion chamber which possesses characteristics, and particularly a volume, suitable for permitting a reequilibration of pressure without extinction of the corresponding flame, whilst in this same circumstance the flames of the other orifices of the burner could disappear. Once the pressure equilibrium is reestablished, this surviving flame is propagated over the periphery of the burner and thus ensures the automatic re-ignition of the latter.

Advantageously, to simplify the manufacture of the burner, the enclosure is defined by a recess extending towards the inside of the burner, provided in the annular crown. Preferably, in this case, the wall defining said recess is approximately semi-circular, with a concavity turned outwardly. To simplify manufacture, the recess is formed in the lower surface of the cap.

For correct operation of the burner, it is desirable for the outlet aperture of the enclosure to possess a horizontal dimension, and to be especially substantially round or substantially square.

To facilitate and accelerate the re-ignition of the burner, it is preferable for the burner to be provided with several recesses, substantially regularly spaced circumferentially.

The invention will be better understood on reading the detailed description which follows of a preferred embodiment given purely by way of non-limiting example.

BRIEF DESCRIPTION OF THE DRAWINGS

In this description reference is made to the accompanying drawing in which.

DESCRIPTION OF PREFERRED EMBODIMENT

Figure 1:
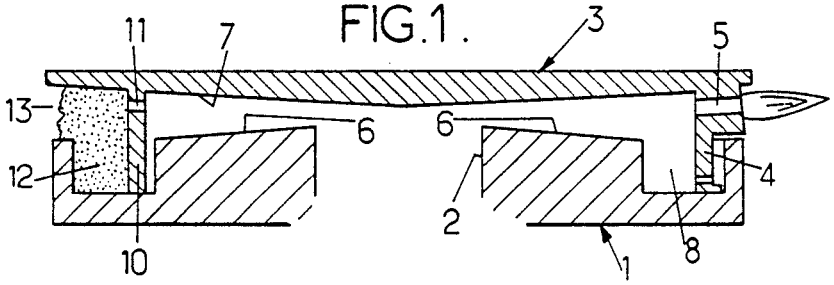
FIG. 1 is a partial diagrammatic view, in cross-section along the line I—I of FIG. 2, of an embodiment of a flat type gas burner constructed according to the invention.

The flat type burner shown diagrammatically and partially in section in FIG. 1 comprises essentially a burner body 1 provided with an inlet passage 2 for inflammable air-gas mixture. Inlet passage 2 is axial, vertical and substantially a cylinder of revolution which shields a gas nozzle (not shown). Cap 3 covers the burner body 1 and rests on the latter through an annular crown 4 provided with flame orifices 5 distributed circumferentially. The annular surface 6 of the burner body which borders the mount of the inlet passage 2 for the inflammable mixture and the opposite surface (lower surface) 7 of the cap 3 are frustoconic to define an annular convergent-divergent system extending approximately transversely to the gas jet. In addition, the burner body 1 and the annular crown 4 define, between their respective opposite surfaces, an annular decompression chamber 8 situated between the convergent-divergent system and the flame orifices 5.

The annular decompression chamber 8 has too small a volume to constitute a buffer enabling a sudden variation in primary air pressure absorbed by the burner to be efficiently dissipated. It is arranged, according to the invention, to furnish one or a small number of flame orifices with their own expansion chamber so that at least one or more flames emerging from this one or more orifices persists despite variations in the pressure of the air.

Figure 2:
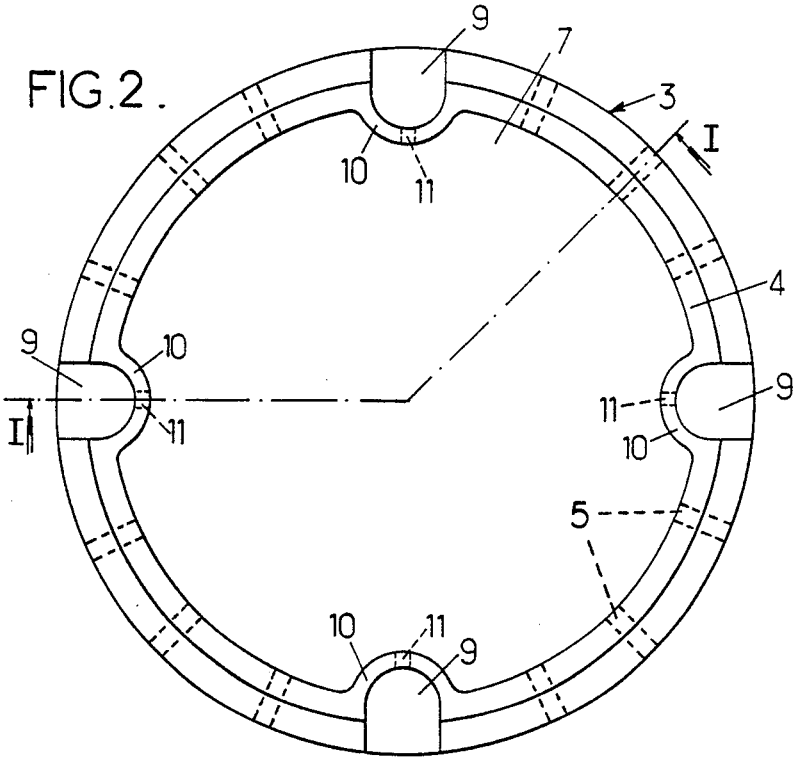
FIG. 2 is a view from below the cap of the gas burner embodiment of FIG. 1.

For this purpose, in one position or at a small number of positions distributed regularly over the perimeter of the annular crown 4 (for example two diametrically opposite orifices, or three orifices offset by 120°, or four orifices offset by 90° as shown in FIG. 2), it is provied for the annular crown 4 to be deformed to form a recess 9 in its outer annular surface. Such deformation may, for example, be a wall 10 in the form of a semicircle with concavity turner outwardly. In each wall 10, there is provided an orifice 11 intended to form a supply orifice for the expansion enclosure 12 defined by the recess 9 and the opposite faces of the burner body 1.

This supply orifice 11 possesses a sufficient cross-section to ensure a flow speed of the gas mixture equal to or in the vicinity of the flow speed through the other flame orifices 5 of the burner.

The volume of the enclosure 12 is such that it permits an expansion of the gaseous mixture so that the pressure inside the enclosure is in the vicinity of the static pressure, whatever the pressure variations of the primary air.

In addition, the cross-section of the outlet aperture 13 of the enclosure is such that the flow speed of the gaseous mixture is about 7 to 12 times below the speed of the gaseous flow supplying the other flame orifices 5.

Finally, in order to avoid a lamination of the flow, the outlet aperture 13 of the enclosure 12 must not be of elongated shape but possess a horizontal dimension and a vertical dimension which are substantially identical. For example, this shape could be substantially square or substantially round.

Figure 3:
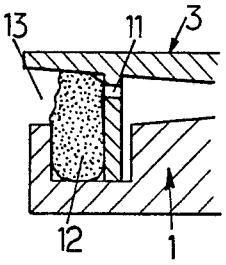
FIGS. 3 to 5 are three diagrammatic views illustrating the operation of the embodiment of the burner of FIGS. 1 and 2 respectively under three different conditions.
Figure 4:
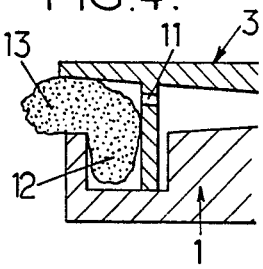
Figure 5:
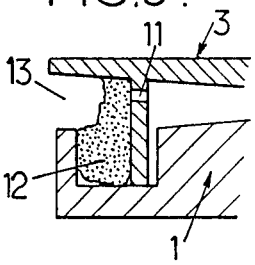

In FIGS. 3 to 5, the operation of the burner under various conditions is illustrated.

In FIG. 3 there is shown the position of the flame in the enclosure 12 on normal operation of the burner with a primary air substantially under ambiant pressure, all the other orifices 5 producing a heating flame. The flame then occupies substantially the whole volume of the enclosure 12.

In FIG. 4 there is shown the position of the flame in the enclosure 12 when the primary air is under excess pressure (for example sudden closing of the oven door). The flame emerges partly through the orifice 13, but it is not blown out, whereas the flames of the other orifices 5 are estinguished. Once the air overpressure disappears, the flame thus preserved in the one or more enclosures 12 is propagated over the periphery of the burner and relights the flames at the outlet of the other orifices 5.

Finally, in FIG. 5 there is shown the position of the flame in the enclosure 12 when the primary air is under reduced pressure (for example sudden opening of the door of the. The) flame is partly sucked into the inside of the enclosure 12, but it is not completely blown out by aspiration, whilst the flames of the other orifices 5 have been extinguished. Once the reduced pressure of the air disappears, the flame thus preserved in one or more of the recesses 12 will be propagated over the periphery of the burner and re-ignite the flame at the outlet of the other orifices 5.

As is self-evident and as emerges from the foregoing, the invention is in no way limited to those of its types of application and embodiments which have been more especially envisaged. It encompasses thereof, on the contrary, all modifications.

What is claimed is:

1. A flat type burner, particularly for a domestic appliance having a gaseous jet, comprising:

a burner body provided with a cylindrical, vertical, and axial gas inlet passage, said gas inlet passage including a mouth and said burner body including an annular surface bordering the mouth which is frustoconic and tapers outwardly;

a cap which covers said burner body, said cap including an annular crown which rests on said body and an opposite surface opposite said annular surface of said burner body which is also frustoconic and tapers outwardly, flame orifices distributed circumferentially around said annular crown;

an annular divergent passage extending approximately transversely to the gaseous jet, said annular divergent passage being defined by said annular surface of said burner body and said opposite surface of said cap;

means forming an annular decompression chamber adjacent said flame orifices; and at least one outwardly open enclosure provided on a periphery of said annular crown in which at least one said flame orifices opens and thereby defines a supply orifice, each said supply orifice having a cross-section whereby the flow speed of the gaseous mixture through said supply orifice is about the same as that of the other said flame orifices, said enclosure having a volume which permits the gaseous mixture to expand to about the static pressure, said enclosure further having an outlet aperture having a cross-section substantially larger than said flame orifices.

2. A burner as claimed in claim 1 wherein said enclosure is a recess provided in said annular crown.

3. A burner as claimed in claim 2 wherein said recess is defined by a wall which is semi-circular and opening outwardly of the center of said burner body.

4. A burner as claimed in claim 2 wherein said recess is formed in said annular crown.

5. A burner as claimed in claim 3 wherein said recess is formed in said annular crown.

6. A burner as claimed in claim 1 wherein said outlet aperture of said enclosure is substantially square.

7. A burner as claimed in claim 2 wherein said outlet aperture of said enclosure is substantially square.

8. A burner as claimed in claim 1 where there are a plurality of said enclosures which are spaced circumferentially and regularly about said annular crown.

9. A burner as claimed in claim 2 where there are a plurality of said enclosures which are spaced circumferentially and regularly about said annular crown.

10. A burner as claimed in claim 7 where there are a plurality of said enclosures which are spaced circumferentially and regularly about said annular crown.

* * * * *